US009594344B1

(12) United States Patent
Sasaki et al.

(10) Patent No.: US 9,594,344 B1
(45) Date of Patent: Mar. 14, 2017

(54) IMAGE FORMING APPARATUS AND INSTALLATION OR REMOVAL OF HOUSING INCLUDING PHOTORECEPTORS

(71) Applicant: FUJI XEROX CO., LTD., Tokyo (JP)

(72) Inventors: Hibiki Sasaki, Kanagawa (JP); Koichi Sato, Kanagawa (JP); Yoshiyuki Takashima, Kanagawa (JP); Atsushi Funada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/990,150

(22) Filed: Jan. 7, 2016

(30) Foreign Application Priority Data

Sep. 11, 2015 (JP) ..... 2015-179877

(51) Int. Cl.
*G03G 15/04* (2006.01)
*G03G 21/18* (2006.01)

(52) U.S. Cl.
CPC ..... *G03G 21/185* (2013.01); *G03G 21/1839* (2013.01); *G03G 21/1842* (2013.01)

(58) Field of Classification Search
CPC ..... G03G 21/1817; G03G 21/1821; G03G 21/1835; G03G 21/1671
See application file for complete search history.

(56) References Cited

U.S. PATENT DOCUMENTS

2004/0184835 A1* 9/2004 Park ..... G03G 21/1821 399/116
2007/0269227 A1* 11/2007 Sato ..... G03G 21/1676 399/13
2008/0219698 A1* 9/2008 Shimizu ..... G03G 15/16 399/116
2011/0303114 A1 12/2011 Katogi
2013/0213174 A1 8/2013 Suzuki et al.

FOREIGN PATENT DOCUMENTS

JP 2011-257628 A 12/2011
JP 2014-061888 A 4/2014
JP 2014-067225 A 4/2014

* cited by examiner

*Primary Examiner* — Clayton E Laballe
*Assistant Examiner* — Victor Verbitsky
(74) *Attorney, Agent, or Firm* — Oliff PLC

(57) ABSTRACT

Provided is an image forming apparatus including plural developing devices that are provided side by side in a direction that is defined by an image forming apparatus main body and respectively form insertion sections into or from which housings including photoreceptors are inserted or withdrawn in a longitudinal direction on one side in a direction in which the plural developing devices are arranged, an exit mechanism that is provided in the developing device, is disposed on an inlet side of the insertion section, and exits a developer on an inside of the developing device, and guide sections of at least two portions that are provided in at least one of the developing devices adjacent to the housing and guide the housing before a surface of the photoreceptor faces the exit mechanism in an insertion direction of the housing when the housing is inserted or withdrawn.

20 Claims, 15 Drawing Sheets

IMAGE FORMING APPARATUS AND INSTALLATION OR REMOVAL OF HOUSING INCLUDING PHOTORECEPTORS

CROSS-REFERENCE TO RELATED APPLICATIONS

This application is based on and claims priority under 35 USC 119 from Japanese Patent Application No. 2015-179877 filed on Sep. 11, 2015.

BACKGROUND

Technical Field

Exemplary embodiments of the invention relate to an image forming apparatus.

SUMMARY

According to an aspect of the invention, there is provided an image forming apparatus including:

plural developing devices that are provided side by side in a direction that is defined by an image forming apparatus main body and respectively form insertion sections into or from which housings including photoreceptors are inserted or withdrawn in a longitudinal direction on one side in a direction in which the plural developing devices are arranged;

an exit mechanism that is provided in the developing device, is disposed on an inlet side of the insertion section, and exits a developer on an inside of the developing device; and guide sections of at least two portions that are provided in at least one of the developing devices adjacent to the housing and guide the housing before a surface of the photoreceptor faces the exit mechanism in an insertion direction of the housing when the housing is inserted or withdrawn.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the drawings.

Figure 1:
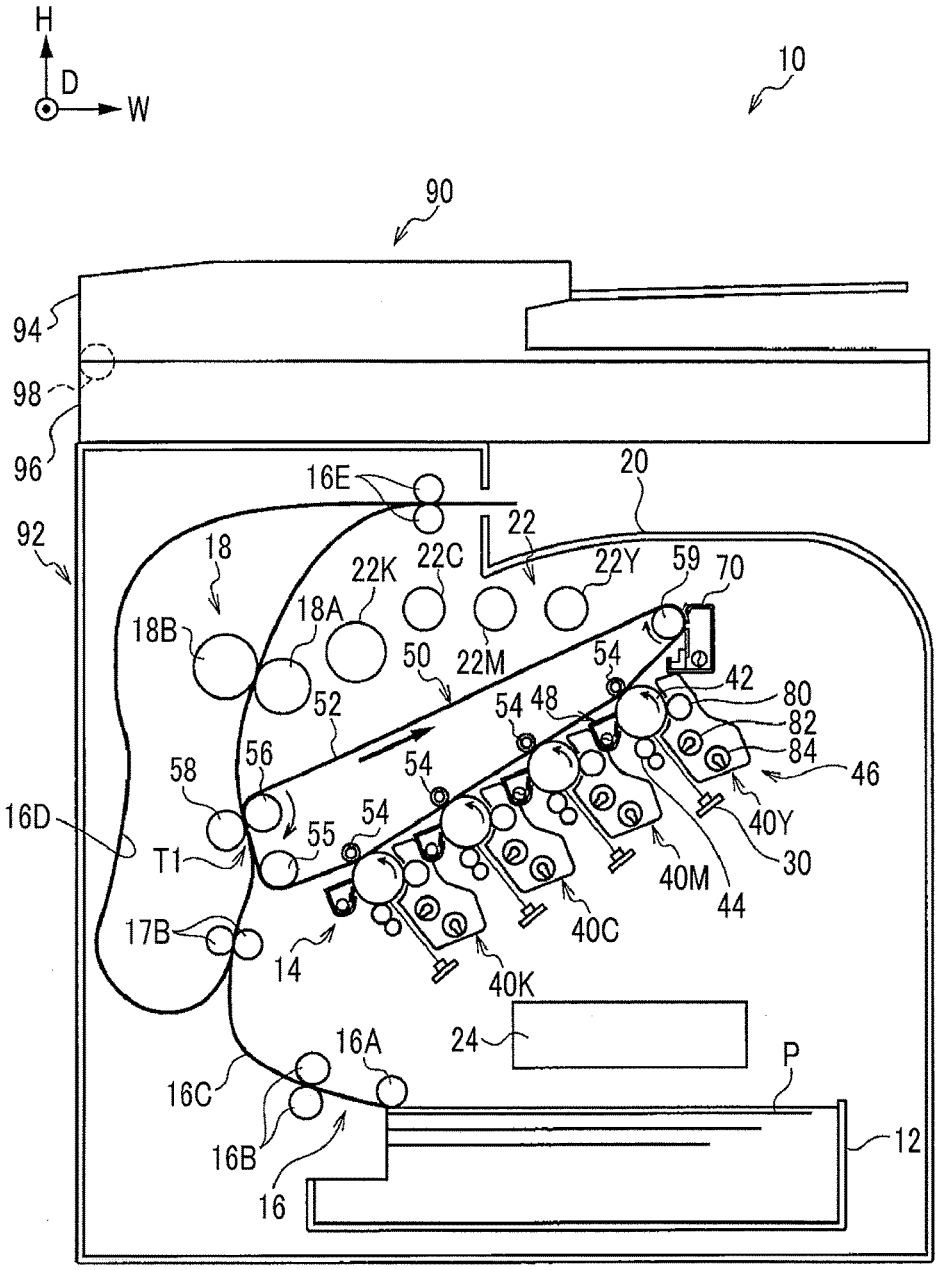
FIG. 1 is a configuration view illustrating an image forming apparatus according to a first exemplary embodiment of the invention.

FIG. 1 is a view illustrating an example of a configuration of an image forming apparatus 10 according to a first exemplary embodiment. Moreover, in the following description, in FIG. 1, a direction represented by arrow H is referred to as a height direction of the apparatus and a direction represented by arrow W is referred to as a width direction of the apparatus. Furthermore, a direction (represented by arrow D) orthogonal to the height direction of the apparatus and the width direction of the apparatus respectively is referred to as a depth direction of the apparatus.

As illustrated in FIG. 1, the image forming apparatus 10 includes an image reading section 90 and an image forming section 92. The image reading section 90 includes a document transport section 94 and a document reading section 96, and the document transport section 94 is configured to be opened and closed to an upper side of the document reading section 96 around a connecting portion 98.

The image forming section 92 is configured to include a recording paper storage section 12 in which recording papers P are stored as the recording media, a toner image forming section 14, a transport section 16, a fixing device 18, an exit section 20, a replenishment mechanism 22, and a control section 24. The toner image forming section 14 includes four image forming units 40Y, 40M, 40C, and 40K, and a transfer unit 50. Here, yellow (Y), magenta (M), cyan (C), and black (K) are an example of toner colors. Each of the image forming units 40Y, 40M, 40C, and 40K includes a photoreceptor 42, a charging device 44, an exposure device 30, a developing device 46, and a removing device 48. A toner image of each color of yellow (Y), magenta (M), cyan (C), and black (K) is formed on an outer periphery of each photoreceptor 42 in each of the image forming units 40Y, 40M, 40C, and 40K. In addition, the image forming units 40Y, 40M, 40C, and 40K are respectively disposed in a state of being arranged to be inclined in a direction intersecting the width direction of the apparatus.

The photoreceptor 42 has a function of holding the toner image that is developed by the developing device 46. The photoreceptor 42 is formed cylindrically, includes a photosensitive layer on a surface thereof, and is driven by a driving unit (not illustrated) to be rotated in an arrow direction.

The developing device 46 develops a latent image formed in the photoreceptor 42 as the toner image. The developing device 46 includes a developing roll 80 that supplies toner to an outer periphery of the photoreceptor 42 and two transport members 82 and 84 that transport a developer containing toner and carrier to the developing roll 80. The replenishment mechanisms 22Y, 22M, 22C, and 22K respectively supply the developer to the developing device 46 of each color.

The transfer unit 50 includes a transfer belt 52, a first transfer roll 54 of each color, a driving roll 56, and a second transfer roll 58. A posture of the transfer belt 52 is determined by four first transfer rolls 54, a support roll 55, the driving roll 56, and a tensioning roll 59 that come into contact with an inner peripheral surface thereof. In the transfer belt 52, a clean device 70 is provided on a downstream side of a second transfer position T1. An outer peripheral surface of each photoreceptor 42 configuring each image forming unit 40 comes into contact with the outer peripheral surface of the transfer belt 52 on a lower side.

The transport section 16 includes a delivery roll 16A, plural transport roll pairs 16B and 17B, an inverted transport section 16D, and an exit roll 16E, and transports the recording paper P delivered by the delivery roll 16A to the exit section 20. The plural transport roll pairs 16B and 17B are disposed along a transporting path 16C in which the recording paper P is transported and transport the recording paper P to the second transfer position T1 that is a position in which the driving roll 56 faces the second transfer roll 58. In addition, the fixing device 18 includes a fixing roll 18A and a pressure roll 18B, and fixes the toner image that is secondarily transferred to the recording paper P to the recording paper P.

In the image forming apparatus 10, exposure light emitted in response to image data of each color from the exposure device is incident on the outer peripheral surface of the photoreceptor 42 that is charged by the charging device 44 in the image forming section 92, and the latent image corresponding to the image data of each color is formed on the outer peripheral surface of each photoreceptor 42. The latent image formed on the outer peripheral surface of each photoreceptor 42 is developed as the toner image of each color by each developing device 46. The toner image of each color on the outer peripheral surface of each photoreceptor 42 is primarily transferred to the outer peripheral surface of the transfer belt 52 by each first transfer roll 54 facing each photoreceptor 42.

On the other hand, the recording paper P is delivered from the recording paper storage section 12 and is transported to the second transfer position T1 in compliance with timing when the toner image of each color that is primarily transferred to the transfer belt 52 reaches the second transfer position T1. In the second transfer position T1, the toner image of each color on the transfer belt 52 is secondarily transferred to the reading paper P. Furthermore, the recording paper P, to which the toner image is transferred is transported to the fixing device 18, is heated and pressed by the fixing roll 18A and the pressure roll 18B, the toner image is fixed onto the recording paper P, and then the recording paper P exits to the exit section 20.

Next, an inserting and withdrawing structure S100 in which a housing (cartridge) 104 including the photoreceptor 42 is inserted or withdrawn into or from an image forming apparatus main body 102 will be described.

Figure 2:
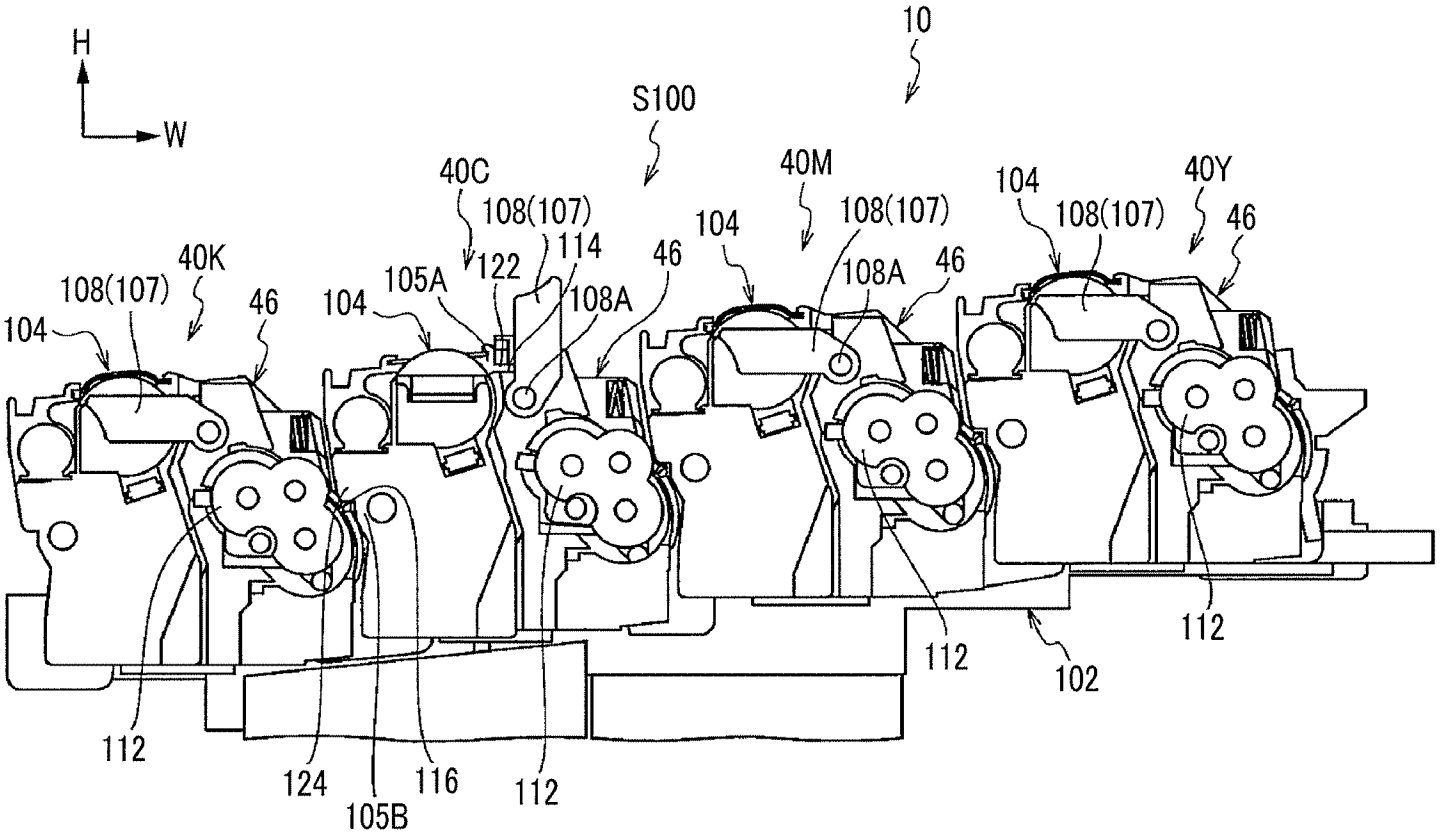
FIG. 2 is a front view illustrating four housings including four developing devices and photoreceptors that are used in the image forming apparatus illustrated in FIG. 1.
Figure 3:
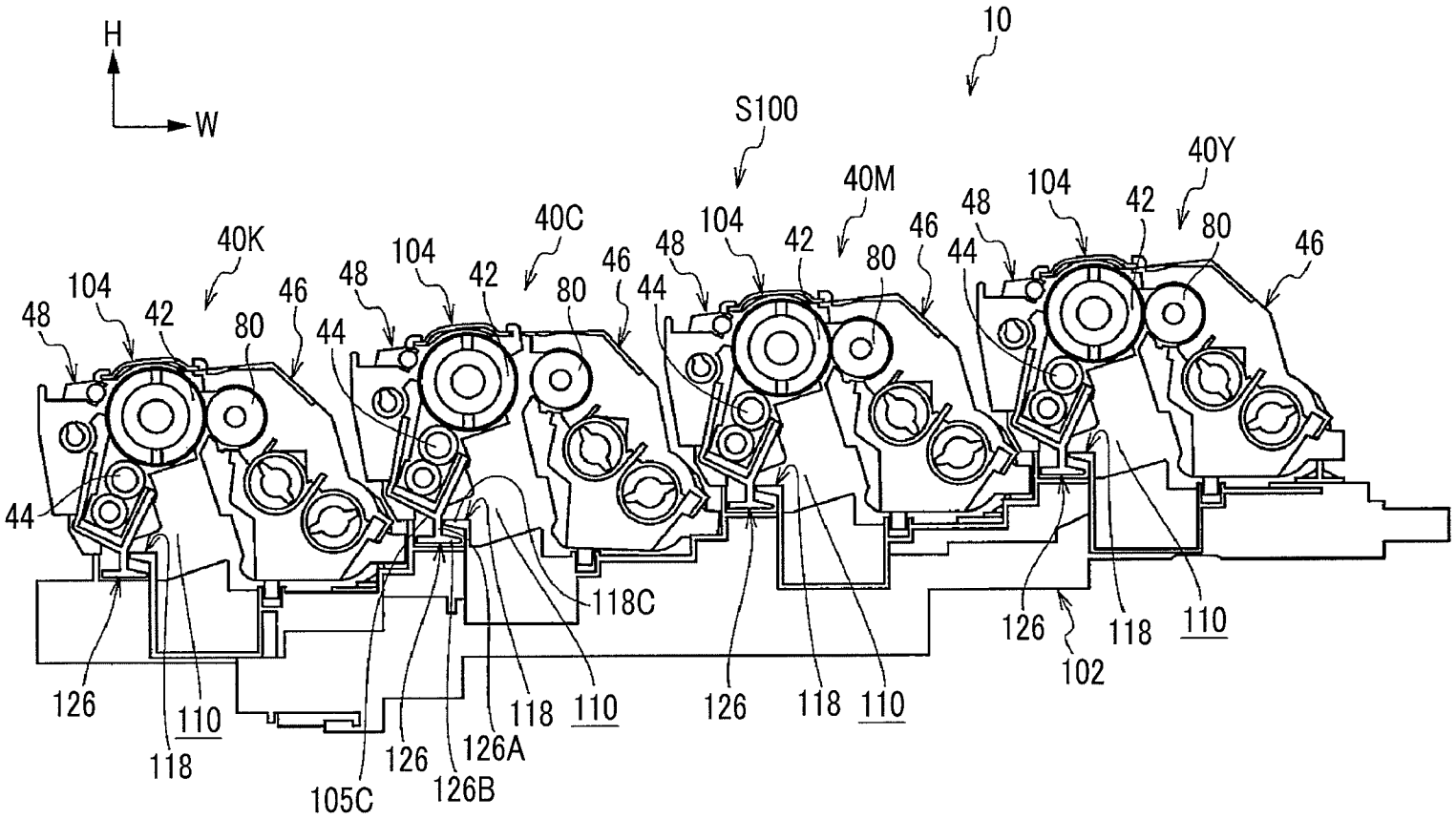
FIG. 3 is a sectional view illustrating four housings including four developing devices and photoreceptors that are used in the image forming apparatus illustrated in FIG. 1.

FIG. 2 is a front view illustrating four housings 104 including four developing devices 46 and the photoreceptors 42 (see FIG. 3) provided in the image forming apparatus 10. FIG. 3 is a sectional view illustrating the four housings 104 including four developing devices 46 and the photoreceptors 42 provided in the image forming apparatus 10. As illustrated in FIGS. 2 and 3, the image forming apparatus 10 includes the image forming apparatus main body 102, four developing devices 46 that are disposed on an inside of the image forming apparatus main body 102 with gaps, and four housings 104 that are disposed in positions adjacent to each developing device 46. Four developing devices 46 are provided to be arranged in a direction inclined with respect to a horizontal direction of the image forming apparatus 10. In the exemplary embodiment, each housing 104 includes the charging device 44, the removing device 48, and the like in addition to the photoreceptor 42.

Each developing device 46 is provided with an operation lever 108 that configures a part of a switching mechanism 107 switching between a contact (connected) state and a retracted (separated) state of the developing device 46 with respect to the housing 104 (see FIG. 2). The operation lever 108 is supported on an outer wall portion of the developing device 46 on a front side of the apparatus to be rotatable around a rotary shaft 108A and is operated when switching between the contact state and the retracted state of the developing device 46 with respect to the housing 104. When a longitudinal direction of the operation lever 108 is disposed substantially in an up and down direction (substantially H direction), the developing device 46 is in the retracted state with respect to the housing 104 (see the image forming unit 40C in FIGS. 2 and 3). In addition, when the longitudinal direction of the operation lever 108 is disposed substantially in the width direction (substantially W direction), the developing device 46 is in the contact state with respect to the housing 104 (see the image forming units 40K, 40M, and 40Y in FIGS. 2 and 3). In the exemplary embodiment, in the contact state of the developing device 46 with respect to the housing 104, the developing roll 80 of the developing device 46 is disposed in contact or close with or to the photoreceptor 42 of the housing 104. In addition, in the retracted state of the developing device 46 with respect to the housing 104, the developing roll 80 of the developing device 46 is retracted with respect to the photoreceptor 42 of the housing 104.

Figure 4:
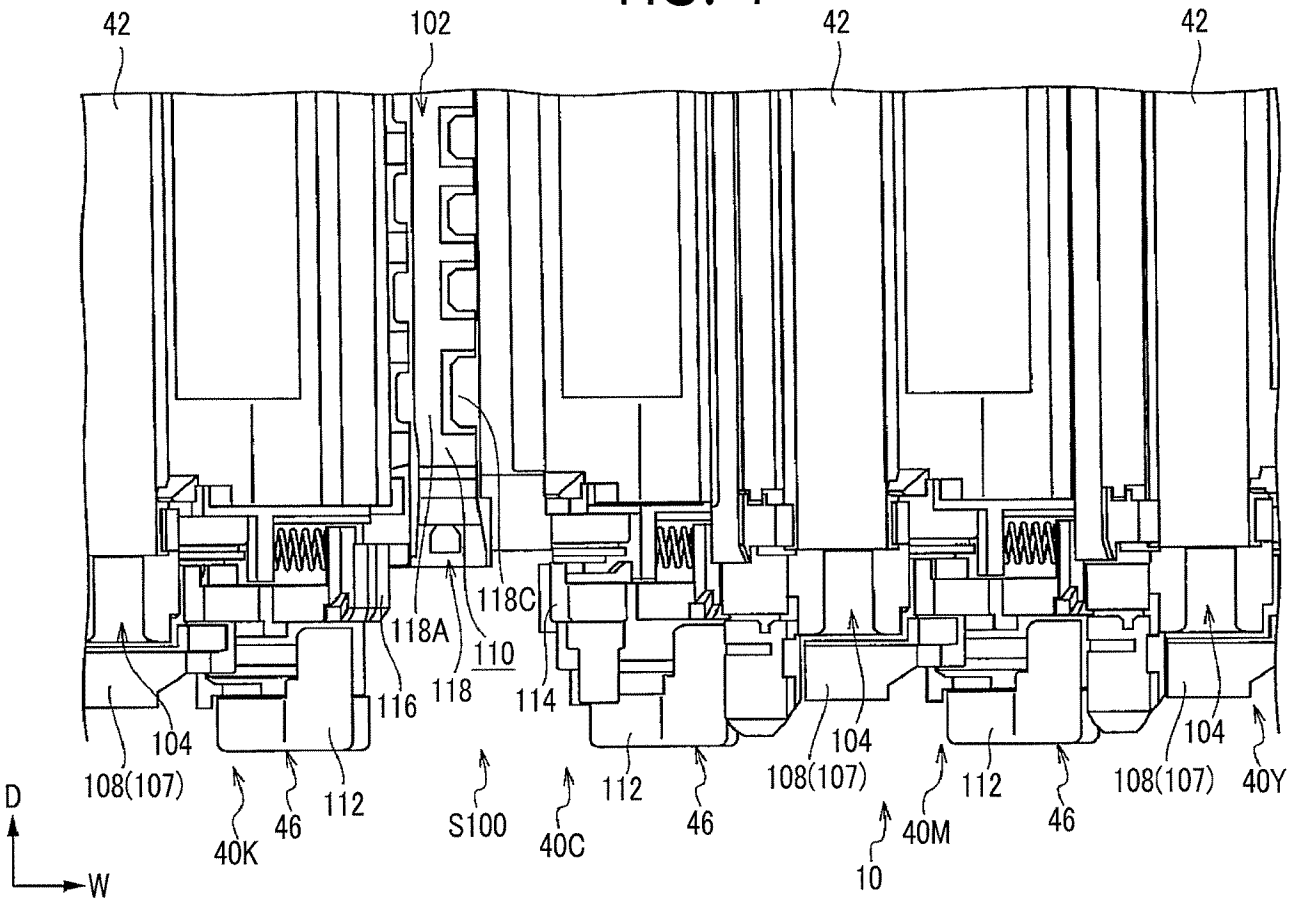
FIG. 4 is a plan view illustrating a state where one housing is withdrawn from an image forming apparatus main body.
Figure 5A:
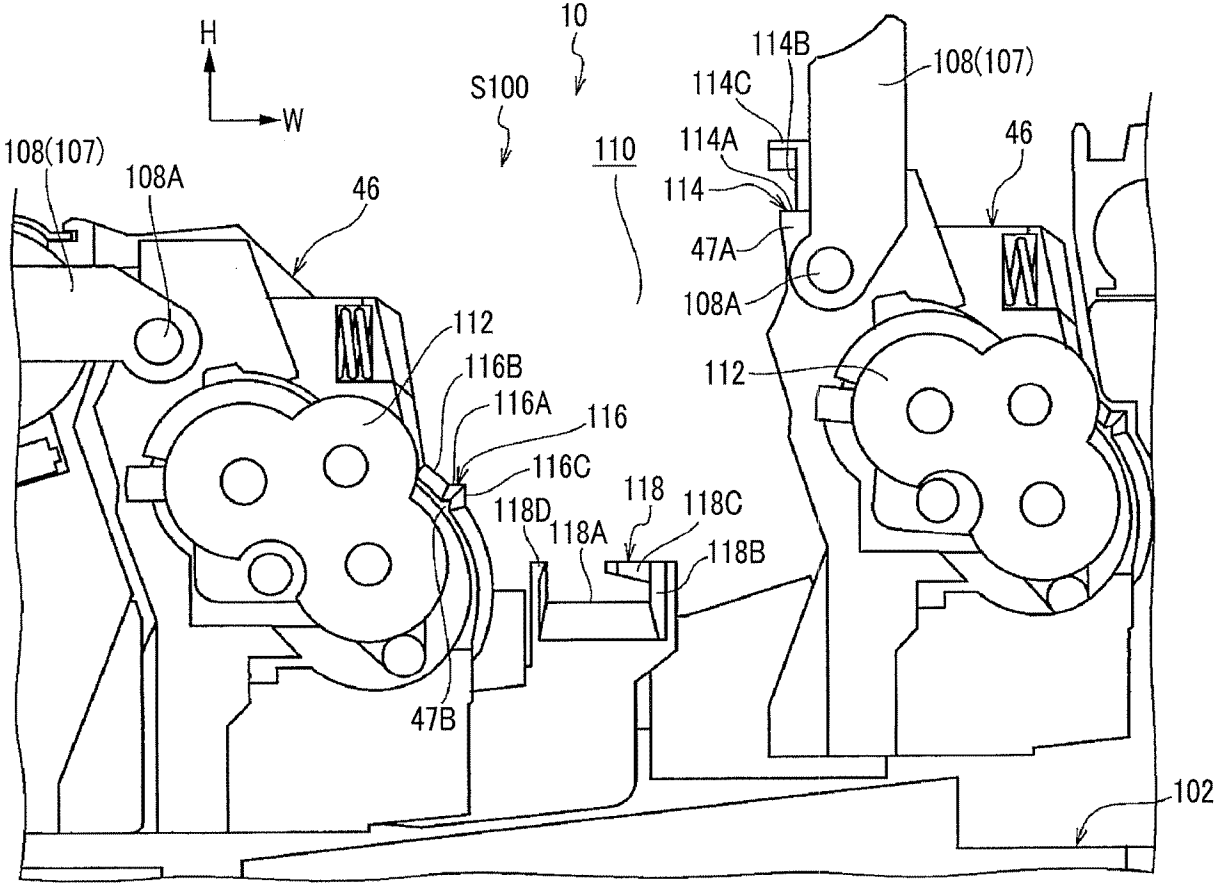
FIG. 5A is a front view illustrating a state where one housing is withdrawn from the image forming apparatus main body.

FIG. 4 is a plan view illustrating a state where one of the housings 104 is withdrawn from an insertion section 110 of the image forming apparatus main body 102. FIG. 5A is a front view illustrating a state where one of the housings 104 is withdrawn from the insertion section 110 of the image forming apparatus main body 102. As illustrated in FIGS. 2 to 5A, each housing 104 is configured to be inserted or withdrawn with respect to the image forming apparatus main body 102 in the depth direction (D direction) of the apparatus. In other words, a space on a left side in a direction in which plural developing devices 46 are arranged on the inside of the image forming apparatus main body 102 when viewed in a plan view is the insertion section 110 in which each housing 104 is inserted or withdrawn with respect to the image forming apparatus main body 102 in the depth direction (ID direction) of the apparatus (see the image forming unit 40C in FIG. 4). The housing 104 is configured to be inserted or withdrawn into or from the image forming apparatus main body 102 in the longitudinal direction (depth direction) of the housing 104.

Moreover, although not illustrated, in the image forming apparatus 10 of the exemplary embodiment, each developing device 46 is configured to be inserted or withdrawn into or from the image forming apparatus main body 102 in the depth direction (D direction) of the apparatus, that is, in the longitudinal direction (the depth direction) of the developing device 46.

As illustrated in FIG. 4, each developing device 46 includes an exit mechanism 112 disposed on an inlet side of the insertion section 110. The exit mechanism 112 is configured to exit the developer on the inside of the developing device 46 to a storage container (not illustrated). The exit mechanism 112 protrudes from a position of the main body portion in which the developing roll 80 (see FIG. 3) of the developing device 46 is provided toward the inlet side (outside from the insertion section 110) of the insertion section 110. In other words, the exit mechanism 112 protrudes with respect to the position in which the photoreceptor 42 of the housing 104 inserted into a back side of the insertion section 110 in the insertion direction is provided toward the inlet side (front side in the D direction) of the insertion section 110.

As illustrated in FIGS. 4 and 5A, a guide section 114 and a guide section 116 in two portions, which guide the housing 104 when the housing 104 is inserted or withdrawn, are provided one by one in the developing devices 46 and 46 on both sides adjacent to the housing 104 (see FIG. 2). More specifically, one guide section 114 is provided in the developing device 46 on the right side adjacent to the housing 104 (see FIG. 2) and the other guide section 116 is provided on the developing device 46 on the left side adjacent to the housing 104.

As illustrated in FIG. 4, the guide sections 114 and 116 in two portions are provided on the inlet side in the insertion direction to the insertion section 110 of the housing 104 when viewed in a plan view. That is, the guide sections 114 and 116 in two portions are not provided in an intermediate portion in the insertion direction in the insertion section 110 of the housing 104. The photoreceptor 42 provided in the housing 104 includes a photosensitive layer 42A of a cylindrical member except an end portion in the axial direction (see FIG. 6). The photosensitive layer 42A is exposed on the right side of the housing 104 in the width direction of the apparatus. The guide sections 114 and 116 in the two portions are provided at positions in which guide of the housing 104 is started before the surface of the photoreceptor 42 (specifically, the photosensitive layer 42A) faces the exit mechanism 112 in the insertion direction (arrow D direction) of the housing 104. In the exemplary embodiment, at least the guide section 114 of the guide sections 114 and 116 in the two portions, which is present on the right side (side on which the photoreceptor 42 is exposed) of the housing 104, may be provided at the position in which guide of the housing 104 is started before the surface of the photoreceptor 42 (photosensitive layer 42A) faces the exit mechanism 112 in the insertion direction (arrow D direction) of the housing 104 (see FIG. 6). The guide sections 114 and 116 in the two portions are provided on both sides of the insertion section 110 of the housing 104, regulate the position of the housing 104 in the width direction (W direction) of the apparatus, and guide the housing 104 in the insertion direction (D direction).

The positions of the guide sections 114 and 116 in the two portions in which guide of the housing 104 is started in the insertion direction (arrow D direction) of the housing 104 are shifted in the insertion direction in a plan view. That is, timing of the guide sections 114 and 116 in the two portions when guide of the housing 104 is started is shifted in the insertion direction (arrow D direction) of the housing 104. In the exemplary embodiment, the guide section 114 on the right side of the insertion section 110 in the width direction (W direction) of the apparatus is provided at the position in which guide of the housing 104 is started in the insertion direction (arrow D direction) of the housing 104 prior to the guide section 116 on the left side of the insertion section 110 (see FIGS. 9A and 9B). That is, the guide section 114 on the right side of the insertion section 110 in the width direction (W direction) of the apparatus is provided so as to start guide of the housing 104 in the insertion direction on the front side more than the guide section 116 on left side of the insertion section 110.

Figure 5B:
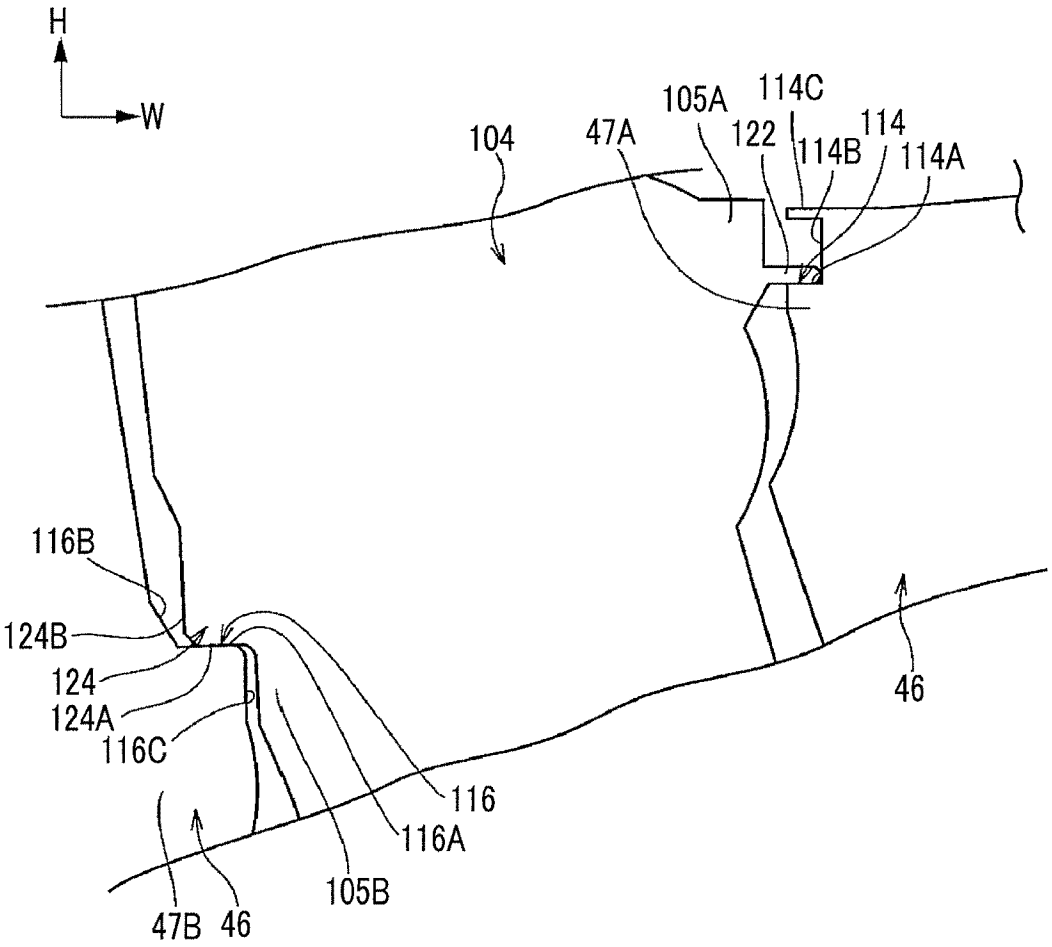
FIG. 5B is a front view schematically illustrating a state where the housing is guided by guide sections in two positions, each of which is provided in each developing device provided on both sides of the housing.

FIG. 5B is a schematic front view illustrating a state where the housing 104 is guided by the guide sections 114 and 116 in the two portions provided one by one in the developing devices 46 and 46 on both sides of the housing 104. As illustrated in FIGS. 5A and 5B, the guide section 114 is provided in a wall portion 47A (wall portion 47A facing the housing 104) on the left side in the width direction of the apparatus in the developing device 46 adjacent to the housing 104 on the right side in the width direction (W direction) of the apparatus. The guide section 114 includes an upper surface portion 114A that are disposed substantially in the width direction (W direction) of the apparatus and substantially in the depth direction (D direction) of the image forming apparatus main body 102, a side surface portion 114B that is erected upward from an end portion of the upper surface portion 114A on an intermediate portion side in the width direction of the apparatus, and a protrusion piece 114C that is disposed along the upper surface portion 114A from an upper end of the side surface portion 114B.

The guide section 116 is provided in a wall portion 47B (wall portion 47B facing the housing 104) on the right side in the width direction of the apparatus in the developing device 46 adjacent to the housing 104 on the left side in the width direction (W direction) of the apparatus. The guide section 116 includes an upper surface portion 116A that are disposed substantially in the width direction (W direction) of the apparatus and substantially in the depth direction (D direction) of the image forming apparatus main body 102, a side surface portion 116B that is inclined from an end portion of the upper surface portion 116A on an intermediate portion side in the width direction of the apparatus with respect to an upper portion side and the intermediate portion side and a side surface portion 116C that is disposed on a lower side from a tip of the upper surface portion 116A. In the exemplary embodiment, the upper surface portion 114A of the guide section 114 is provided in a position higher than a height of the upper surface portion 116A of the guide section 116.

Figure 10B:
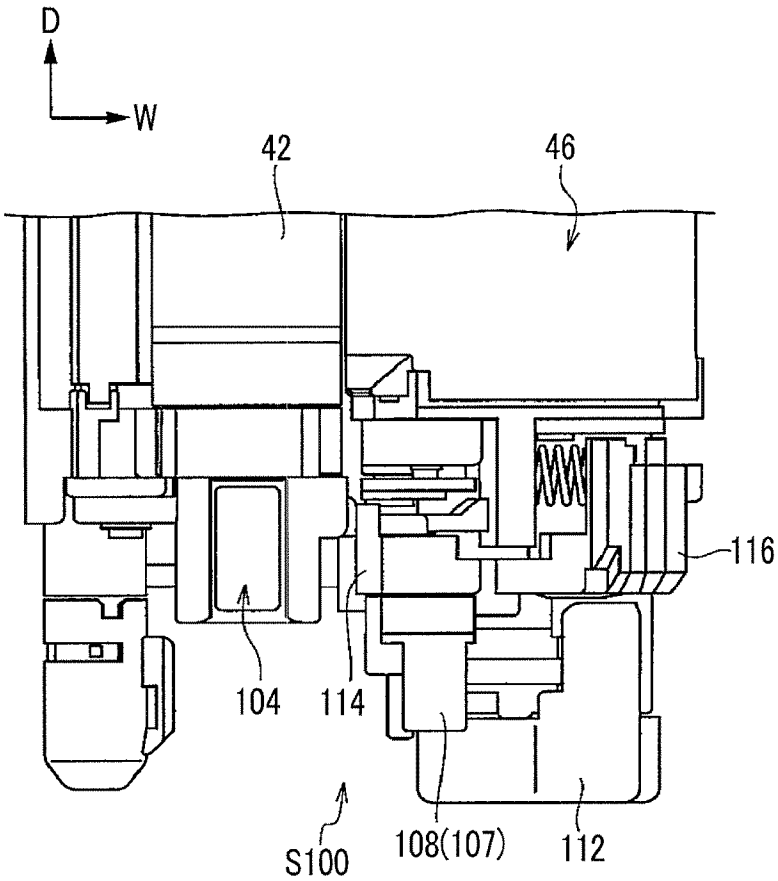
FIG. 10A is a front view illustrating a state where the developing device is retracted from the housing in a state where the housing is inserted into an inner end portion of the image forming apparatus main body in an insertion direction and FIG. 10B is a plan view illustrating a state where the developing device is retracted from the housing in a state where the housing is inserted into the inner end portion of the image forming apparatus main body in the insertion direction.
Figure 10A:
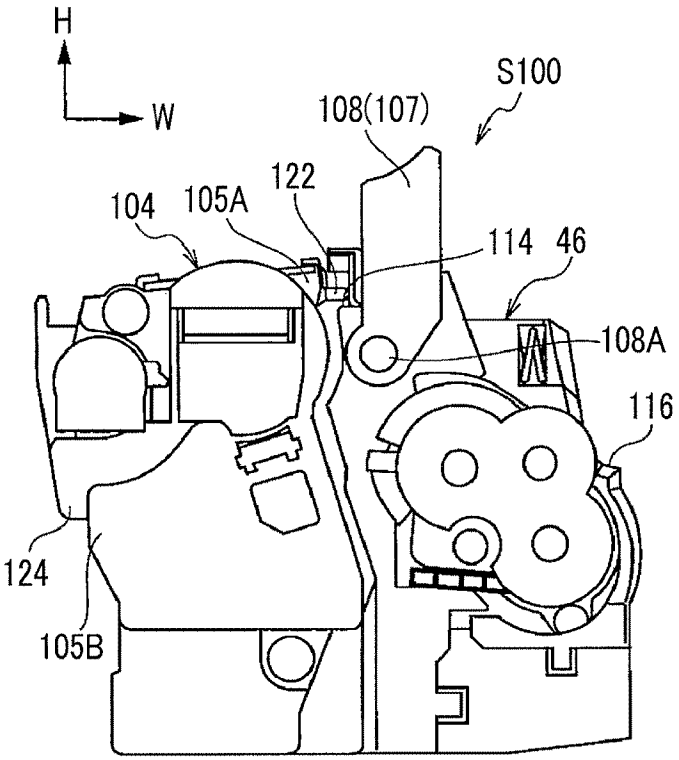
Figure 11B:
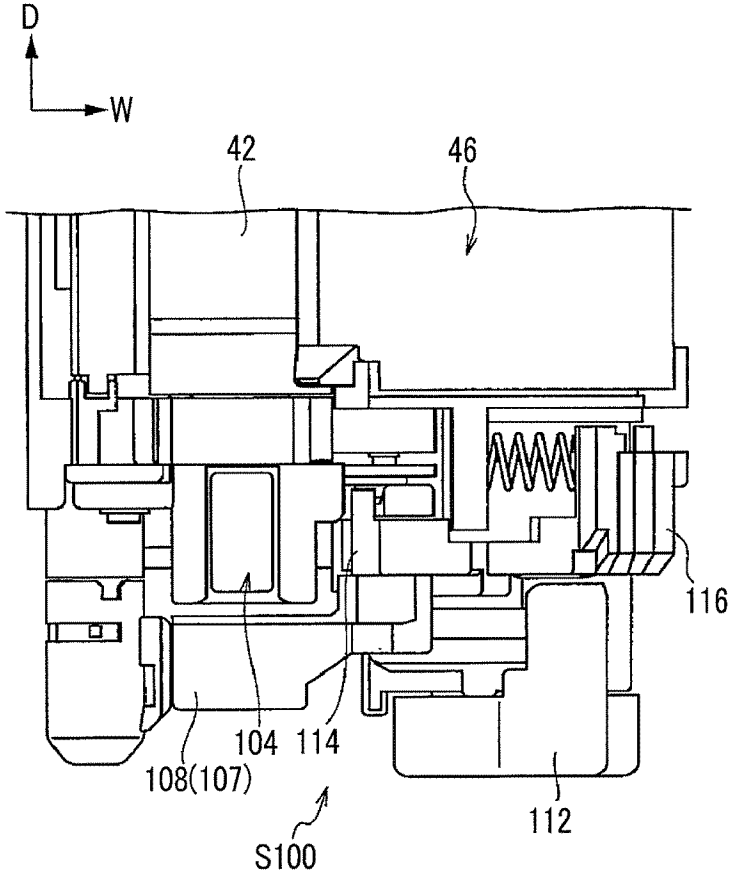
FIG. 11A is a front view illustrating a state where the developing device is in contact with the housing in a state where the housing is inserted into the inner end portion of the image forming apparatus main body in the insertion direction and FIG. 11B is a plan view illustrating a state where the developing device is in contact with the housing in a state where the housing is inserted into the inner end portion of the image forming apparatus main body in the insertion direction.
Figure 11A:
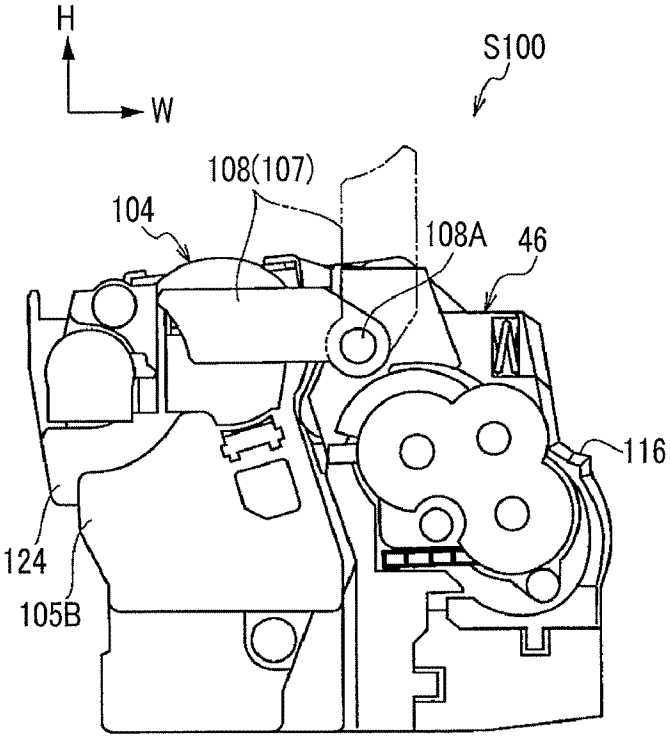

FIGS. 10A and 10B are respectively a front view and a plan view illustrating a state where a tip of the operation lever 108 is rotated on an upper side (H direction) and the developing device 46 is retracted (separated) with respect to the housing 104. In addition, FIGS. 11A and 11B are respectively a front view and a plan view illustrating a state where the tip of the operation lever 108 is rotated in the width direction (W direction) of the apparatus and the developing device 46 is in contact (coming into contact) with the housing 104. As illustrated in FIGS. 10A to 11B, a part of the developing device 46 is swung by an operation of the switching mechanism 107 by the operation lever 108. The guide sections 114 and 116 in the two portions are provided in positions (portions) that are not moved by the operation of the switching mechanism 107 in the developing device 46. In other words, the guide sections 114 and 116 in the two portions are provided in fixed positions (portions of the developing device 46 which are not swung) of the developing device 46, which are not affected by the operation of the switching mechanism 107 by the operation lever 108.

As illustrated in FIGS. 2 and 5B, a rib 122 is provided in a wall portion 105A facing the developing device 46 on the right side of the housing 104 when viewed in a front view as a contact portion protruding on the guide section 114 side (see the image forming unit 40C in FIG. 2). In the exemplary embodiment, the rib 122 protrudes from the wall portion 105A in the width direction (W direction) of the apparatus. When the housing 104 is inserted or withdrawn into or from the image forming apparatus main body 102, the rib 122 is inserted between the upper surface portion 114A and the protrusion piece 114C of the guide section 114. A tip of the rib 122 is disposed to have a margin so as to come into contact or separate with or from the side surface portion 114B of the guide section 114. Then, a lower surface portion of the rib 122 on a tip side swings the upper surface portion 114A of the guide section 114. Thus, a position of the housing 104 on the right side in the up and down direction and in the width direction of the apparatus is regulated, and the housing 104 is guided in the insertion direction (arrow D direction) (see FIG. 6).

In this case, the housing 104 (photoreceptor 42) and the developing device 46 are configured to maintain a distance therebetween in a state where the tip of the rib 122 is in contact with the side surface portion 114B of the guide section 114. That is, a length of the rib 122 in the width direction (W direction) of the apparatus is set to maintain the distance between the housing 104 (photoreceptor 42) and the developing device 46 in a state where the tip of the rib 122 is in contact with the side surface portion 114B of the guide section 114 (see the image forming unit 40C in FIGS. 5B and 2).

As illustrated in FIGS. 2 and 5B, a protrusion section 124 protruding on the guide section 116 side is provided in a wall portion 105B facing the developing device 46 on the right side of the housing 104 when viewed in a front view. In the exemplary embodiment, a lower surface portion 124A of the protrusion section 124 protrudes from the wall portion 105B in the width direction (W direction) of the apparatus. When the housing 104 is inserted or withdrawn into or from the image forming apparatus main body 102, the lower surface portion 124A of the protrusion section 124 slides on the upper surface portion 116A of the guide section 116. Thus, the position of the housing 104 in the up and down direction and the width direction of the apparatus is regulated, and the housing 104 is guided in the insertion direction (arrow D direction) (see FIGS. 2 and 6). A side surface portion 124B of the protrusion section 124 is disposed to have a margin so as to come into contact or separate with or from the side surface portion 116B of the guide section 116.

Figure 6:
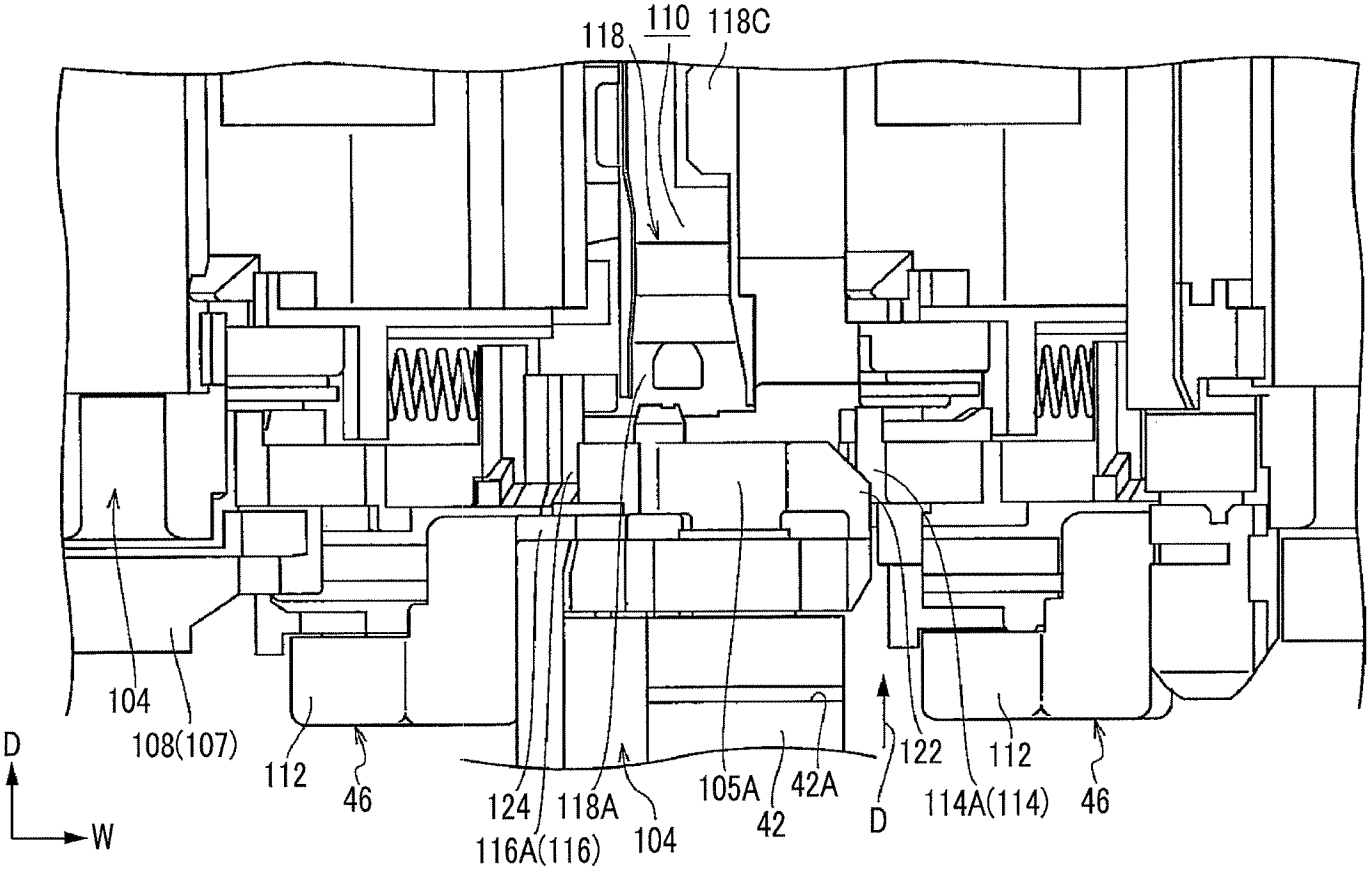
FIG. 6 is a plan view illustrating a state where the housing is guided by one of the guide sections each of which is provided in each developing device provided on both sides of the housing in a process of inserting the housing into the image forming apparatus main body.
Figure 9A:
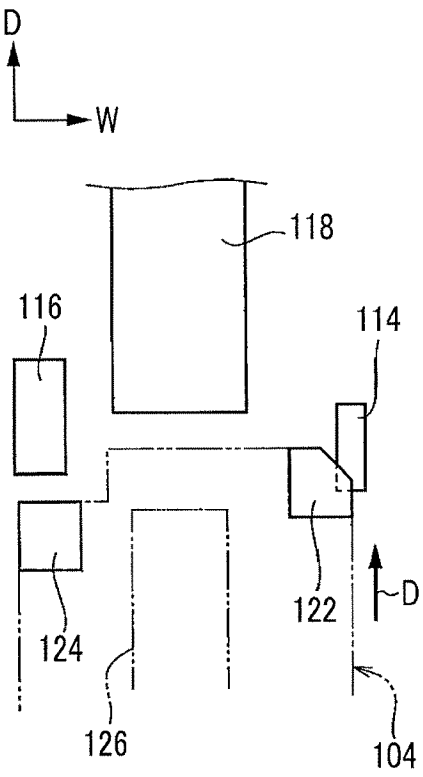
FIG. 9A is a schematic plan view illustrating a state where a rib of the housing comes into contact with the guide section on a right side of the developing device.
Figure 9B:
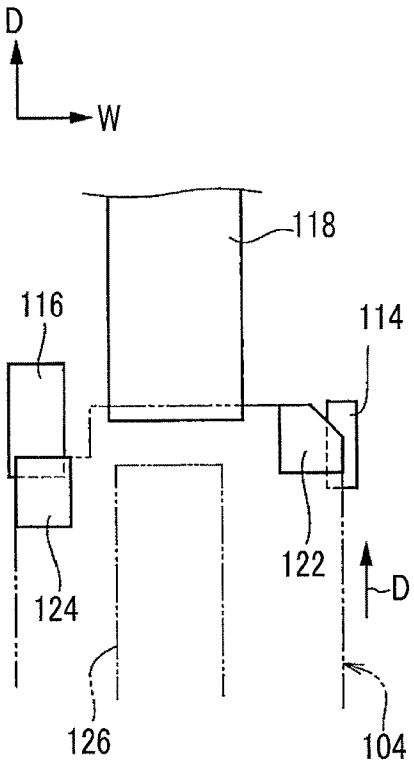
FIG. 9B is a schematic plan view illustrating a state where the rib and a protrusion section of the housing come into contact with the guide sections of two positions on both sides of the developing device.

As illustrated in FIGS. 6, 9A, and 9B, positions of the rib 122 and the protrusion section 124, in which contact of the guide sections 114 and 116 is started in the insertion direction (arrow D direction) of the housing 104, are shifted in the insertion direction when viewed in a plan view. That is, an end portion of the rib 122 on the back side in the insertion direction is disposed on the back side in the insertion direction more than an end portion of the protrusion section 124 on the back side in the insertion direction, in the insertion direction (arrow D direction) of the housing 104. Thus, when inserting the housing 104 in the insertion direction (arrow D direction), the rib 122 firstly comes into contact with the guide section 114 and then the protrusion section 124 comes into contact with the guide section 116.

In the inserting and withdrawing structure S100, when the housing 104 is inserted or withdrawn into or from the image forming apparatus main body 102, the rib 122 of the housing 104 comes into contact with the guide section 114 and the protrusion section 124 of the housing 104 comes into contact with the guide section 116. Thus, the posture of the housing 104 is maintained.

As illustrated in FIGS. 3 to 5A, and 9C, a support section 118 that supports the housing 104 in the insertion direction of the housing 104 from a position, before the rib 122 and the protrusion section 124 of the housing 104 leaves the guide sections 114 and 116 in the insertion direction of the housing 104, is provided in the image forming apparatus main body 102. The support section 118 is configured to support the housing 104 from the inlet side to the back side in the insertion direction to the insertion section 110 of the housing 104 in the insertion direction (arrow D direction). The inlet side of the support section 118 in the insertion direction (arrow D direction) of the housing 104 is disposed so as to overlap the guide sections 114 and 116 (see FIGS. 4 and 9C) in a plan view.

As illustrated in FIG. 5A, the support section 118 includes a bottom surface portion 118A that supports the lower portion of the housing 104, a wall portion 118B that is erected upward from an end portion of the bottom surface portion 118A in the width direction (W direction) of the apparatus, and a support piece 118C that extends along the bottom surface portion 118A from an upper end portion of the wall portion 118B. Furthermore, the support section 118 includes a wall portion 118D that is erected upward from the other end portion of the bottom surface portion 118A in the width direction (W direction) of the apparatus. A length of the support piece 118C in the width direction (W direction) of the apparatus is set to be shorter than a length of the bottom surface portion 118A in the width direction (W direction) of the apparatus. That is, a gap is formed between a tip of the support piece 118C and an upper end portion of the wall portion 118D.

As illustrated in FIG. 3, a protrusion piece 126 protruding substantially in a T-shape is provided in a lower portion of the housing 104. The protrusion piece 126 includes a wall portion 126A that extends downward from a lower wall portion 105C of the housing 104 and a flange portion 126B that extends to a lower end portion of the wall portion 126A on both sides of the wall portion 126A when viewed in a front view. When the housing 104 is inserted or withdrawn into or from the insertion section 110 of the image forming apparatus main body 102, the wall portion 126A of the protrusion piece 126 of the housing 104 is inserted into the gap between the support piece 118C and the wall portion 118D, and the flange portion 126B is inserted between the support piece 118C and the bottom surface portion 118A of the support section 118. Then, the flange portion 126B slides on the bottom surface portion 118A. Thus, the flange portion 126B is guided to the support section 118 and the posture of the housing 104 is maintained.

Figure 12:
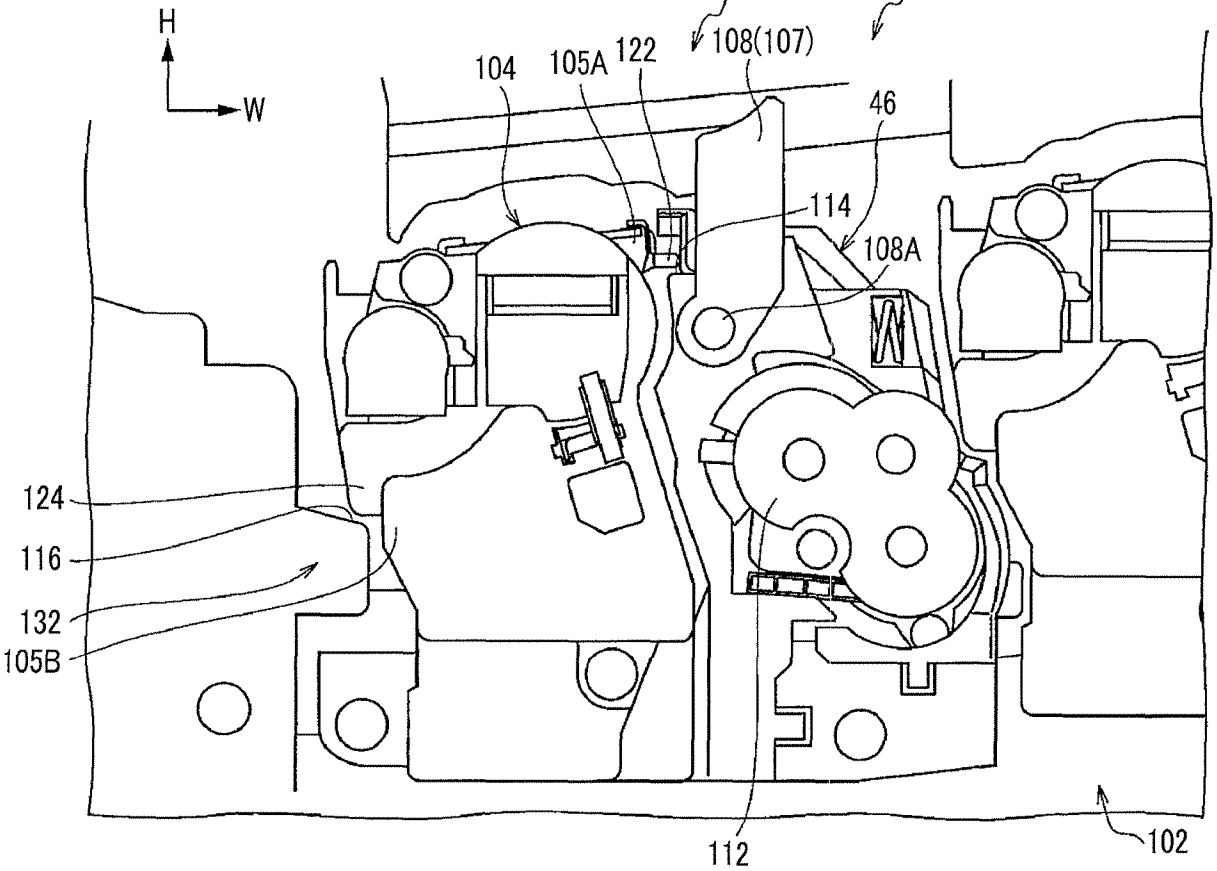
FIG. 12 is a front view illustrating a state where the housing that is inserted into insertion section adjacent to a black developing device is guided by the guide sections in two portions.

As illustrated in FIG. 12, in the image forming unit 40K of black that is positioned in the most left side in the width direction (W direction) of the apparatus, the developing device is not provided on the left side of the housing 104 including the photoreceptor 42. Thus, in the image forming apparatus 10, the guide section 116 is provided in a wall portion (housing) 132 disposed on the left side of the image forming apparatus main body 102 in the width direction (W direction) of the apparatus. That is, the image forming unit 40K of black is configured such that the rib 122 on the right side of the housing 104 is guided by the guide section 114 of the developing device 46 adjacent to the right side of the housing 104 and the protrusion section 124 on the left side of the housing 104 is guided by the guide section 116 provided in the wall portion 132 on the left side of the image forming apparatus main body 102.

Next, operations and effects of the inserting and withdrawing structure S100 of the housing 104 provided in the image forming apparatus 10 according to the exemplary embodiment will be described.

The housing 104 including the photoreceptor 42 is inserted or withdrawn into or from the insertion section 110 of the image forming apparatus main body 102 in the longitudinal direction of the housing 104. That is, the housing 104 is inserted into the insertion section 110 of the image forming apparatus main body 102 in the depth direction (D direction) of the apparatus.

In the image forming apparatus 10, the housing 104 is guided by the guide section 114 of the developing device 46 adjacent to the right side and the housing 104 is guided by the guide section 116 of the developing device 46 adjacent to the left side on the inlet side in the insertion direction (arrow D direction) of the housing 104 in compliance with insertion or withdrawal of the housing 104 into or from the insertion section 110 of the image forming apparatus main body 102.

For example, as illustrated in FIGS. 6 and 9A, when inserting the housing 104 into the insertion section 110 of the image forming apparatus main body 102 in the arrow D direction, the rib 122 on the right side of the housing 104 is guided by the guide section 114 of the developing device 46 on the right side on the inlet side of the housing 104 in the insertion direction. That is, the lower surface portion of the rib 122 on the right side of the housing 104 slides on the upper surface portion 114A of the guide section 114 of the developing device 46 on the right side.

Figure 7:
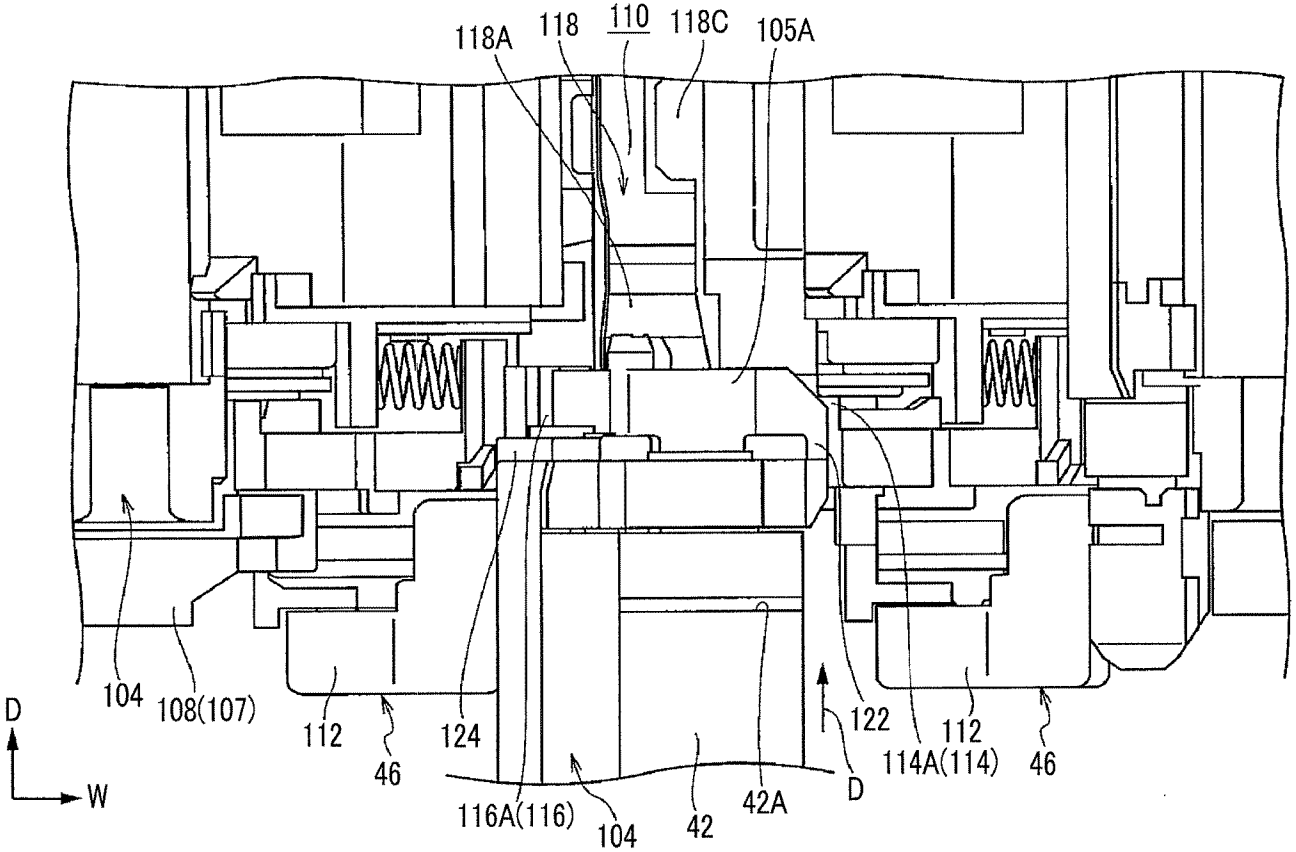
FIG. 7 is a plan view illustrating a state where the housing is guided by the guide sections in two positions, each of which is provided in each developing device provided on both sides of the housing in the process of inserting the housing into the image forming apparatus main body.
Figure 8:
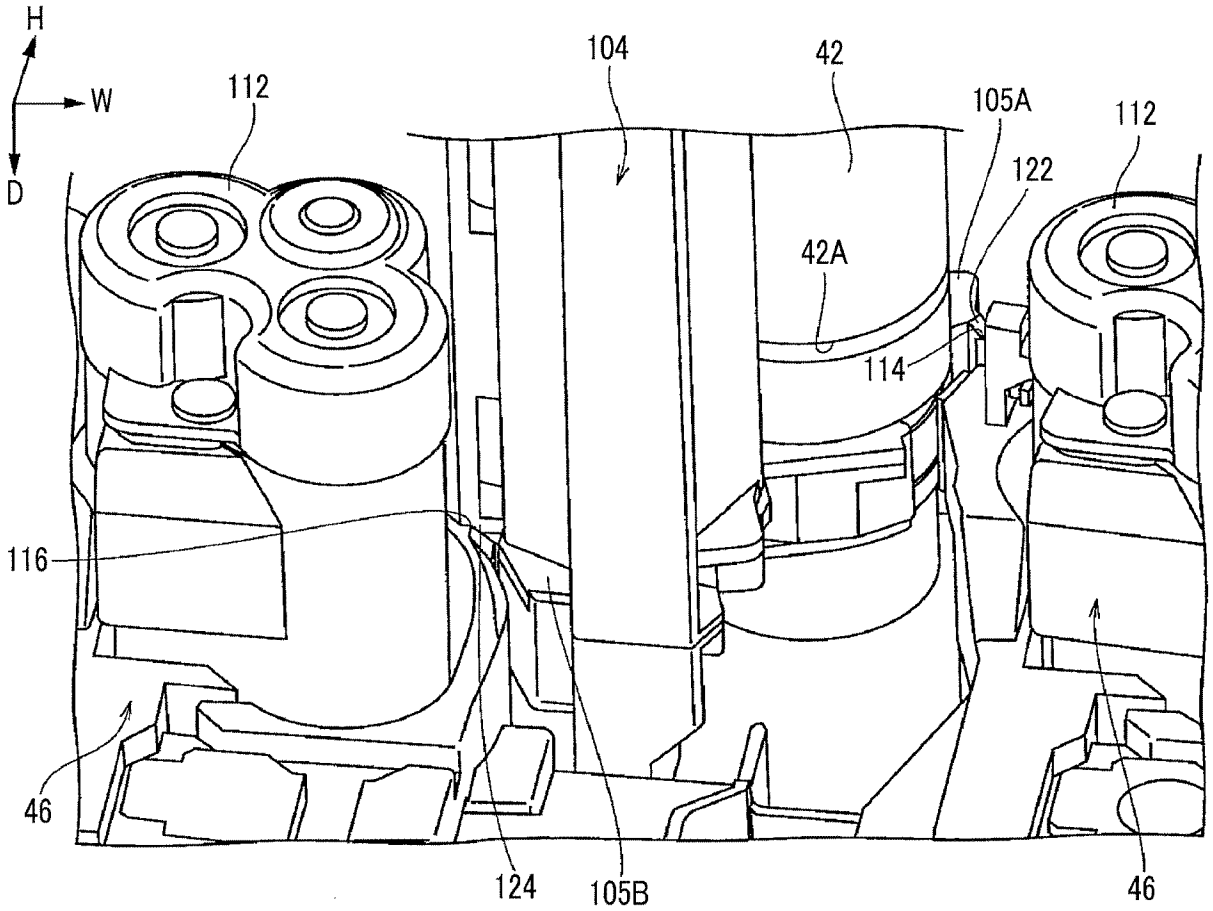
FIG. 8 is a perspective view that is viewed from below illustrating a state where the housing is guided by the guide sections in two positions, each of which is provided in each developing device provided on both sides of the housing in the process of inserting the housing into the image forming apparatus main body.

As illustrated in FIGS. 7, 8, and 9B, when inserting the housing 104 into the insertion section 110 of the image forming apparatus main body 102 in the arrow D direction, the protrusion section 124 on the left side of the housing 104 is guided by the guide section 116 of the developing device 46 on the left side on the inlet side of the housing 104 in the insertion direction. That is, the lower surface portion 124A of the protrusion section 124 on the left side of the housing 104 slides on the upper surface portion 116A of the guide section 116 of the developing device 46 on the left side (see FIG. 5B).

In this case, at least the guide section 114 on the right side (side on which the photoreceptor 42 is exposed) of the housing 104 in the guide sections 114 and 116 in the two portions is provided in the position in which guide of the housing 104 is started before the surface of the photoreceptor 42 (photosensitive layer 42A) faces the exit mechanism 112 in the insertion direction (arrow D direction) of the housing 104 (see FIG. 6). Thus, in the image forming apparatus 10, interference in the exit mechanism 112 of the developing device 46 and the surface of the photoreceptor 42 is suppressed and then occurrence of scratches on the surface of the photoreceptor (photosensitive layer 42A) is suppressed compared to a configuration in which the guide section that guides the housing before the surface of the photoreceptor faces the exit mechanism of the developing device is not provided.

In addition, in the image forming apparatus 10, the guide sections 114 and 116 in the two portions are disposed to shift the positions thereof in the insertion direction, in which the housing 104 is guided in the insertion direction (arrow D direction) of the housing 104 when viewed in a plan view. In the exemplary embodiment, the guide section 114 on the right side of the insertion section 110 is provided in a position to guide the housing 104 in the insertion direction (arrow D direction) of the housing 104 prior to the guide section 116 on the left side of the insertion section 110.

Thus, as illustrated in FIGS. 6, 7, 9A, and 9B, the rib 122 on the right side of the housing 104 comes into contact with the guide section 114 of the developing device 46 on the right side and guide is started, and then the protrusion section 124 on the left side of the housing 104 starts the guide by coming into contact with the guide section 116 of the developing device 46 on the left side. Thus, in the image forming apparatus 10, the positions, in which the guide of the guide sections 114 and 116 in the two portions is started, are shifted in the insertion direction of the housing 104 by firstly guiding the rib 122 of the housing 104 by the guide section 114. Thus, in the image forming apparatus 10, since the guide of the housing is not necessary to be performed simultaneously by the guide sections in the two portions, workability is improved when starting the guide of the housing 104 by the guide sections 114 and 116 in the two portions compared to a configuration in which the positions of the guide sections in the two portions are not shifted in the insertion direction of the housing.

In addition, in the image forming apparatus 10, the guide sections 114 and 116 are provided one by one in the developing devices 46 and 46 on both sides adjacent to the housing 104. Thus, in the image forming apparatus 10, the posture of the housing 104 is stabilized compared to a configuration in which only one guide section is provided in the developing device on one side adjacent to the housing.

In addition, in the image forming apparatus 10, as illustrated in FIGS. 10A to 11B, the guide sections 114 and 116 in the two portions are provided in the positions that are not moved by the operation of the switching mechanism 107 in the developing device 46. Thus, in the image forming apparatus 10, since looseness of the housing 104 is eliminated during insertion or withdrawal of the housing 104, occurrence of variations in the workability is reduced (change in workability is reduced during insertion or withdrawal of the housing 104) compared to a case where the guide sections are provided in positions that are moved by the operation of the switching mechanism in the developing device.

In addition, in the image forming apparatus 10, the rib 122 coming into contact with the guide section 114 is provided in the housing 104 and the photoreceptor 42 and the developing device 46 are configured to maintain the distance therebetween in a state where the rib 122 is in contact with the guide section 114 (see the image forming unit 40C in FIGS. 5B and 2). Thus, in the image forming apparatus 10, interference in the photoreceptor and the developing device is suppressed compared to a configuration in which a contact section maintaining the distance between the photoreceptor and the developing device in a state of being in contact with the guide section is not provided.

Figure 9C:
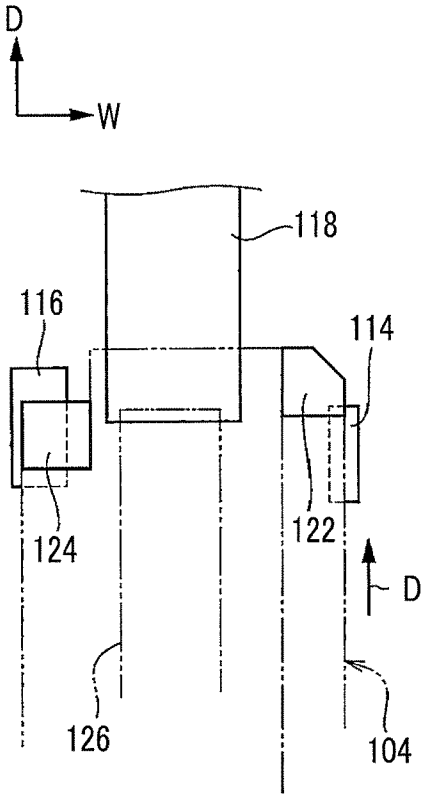
FIG. 9C is a plan view illustrating a state where the protrusion section of the housing is supported by a support section before a contact portion of the housing leaves the guide sections in two portions.

When further inserting the housing 104 into the insertion section 110 of the image forming apparatus main body 102 from the state illustrated in FIG. 7, as illustrated in FIGS. 3 and 9C, the protrusion piece 126 of the lower portion of the housing 104 is supported by the support section 118 of the image forming apparatus main body 102. That is, the housing 104 is inserted while the flange portion 126B of the protrusion piece 126 of the housing 104 is supported by the support section 118. In this case, in the image forming apparatus 10, the support section 118 is configured to support the housing 104 from the position before the rib 122 and the protrusion section 124 of the housing 104 leave the guide sections 114 and 116 in the insertion direction (arrow D direction) of the housing 104. That is, the inlet side of the support section 118 is disposed so as to overlap with the guide sections 114 and 116 in the insertion direction (arrow D direction) of the housing 104 (see FIGS. 6 and 9A to 9C). Thus, the protrusion piece 126 of the housing 104 is supported by the support section 118 before the rib 122 and the protrusion section 124 of the housing 104 are departed from the guide sections 114 and 116.

Thus, in the image forming apparatus 10, the posture of the housing 104 is stabilized before and after the housing 104 leaves the guide sections 114 and 116 compared to a configuration in which the support section that supports the housing from the position before the housing leaves the guide sections in the insertion direction of the housing is not provided.

Figure 14:
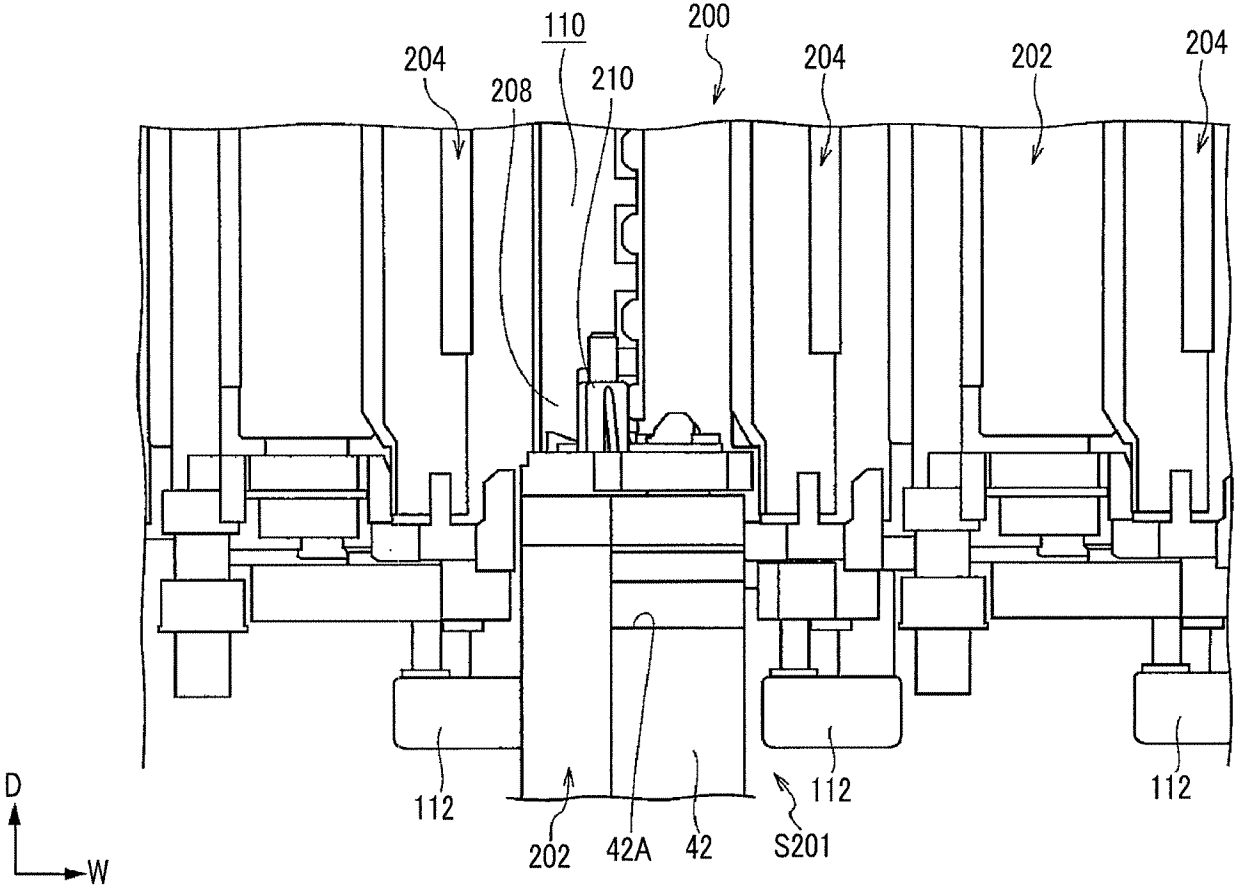
FIG. 14 is a plan view illustrating a process of inserting a housing in an insertion direction, which is used in an image forming apparatus of a comparison example.

FIG. 14 is a plan view illustrating an inserting and withdrawing structure 5201 in which a housing 202 including a photoreceptor 42 used in an image forming apparatus 200 of a comparison example is inserted or withdrawn. As illustrated in FIG. 14, the housing 202 is inserted into the insertion section 110 of the image forming apparatus 200 in a longitudinal direction of the housing 202. That is, the housing 202 is inserted into the insertion section 110 of the image forming apparatus 200 in a depth direction (D direction) of the apparatus. Developing devices 204 are provided on both sides of the insertion section 110 into which the housing 202 is inserted in a width direction (W direction) of the apparatus. The exit mechanism 112 protruding on the outside more than the insertion section 110 is provided on an inlet side of the housing 202 in the insertion direction (arrow D direction) in the developing device 204.

A guide section 208 that guides the housing 202 is provided on a lower side of the insertion section 110 of the image forming apparatus 200. A protrusion section 210 coming into contact with the guide section 208 is provided in the housing 202 on a back side in the insertion direction. Then, when the housing 202 is inserted into the insertion section 110 of the image forming apparatus 200 in an arrow D direction, the lower portion of the protrusion section 210 of the housing 202 comes into contact with the guide section 208. Thus, a position of the housing 202 is regulated and the housing 202 is guided in the insertion direction.

In the image forming apparatus 200, when the lower portion of the protrusion section 210 of the housing 202 comes into contact with the guide section 208 and guide is started, a surface of the photoreceptor 42 (photosensitive layer 42A) faces the exit mechanism 112. Thus, interference in the surface of the photoreceptor 42 and the exit mechanism 112 is not suppressed and scratches on the surface of the photoreceptor 42 may occur.

In contrast, in the image forming apparatus 10, at least the guide section 114 on the right side (side on which the photoreceptor 42 is exposed) of the housing 104 in the guide sections 114 and 116 in the two portions is provided in the position in which guide of the housing 104 is started before the surface of the photoreceptor 42 (photosensitive layer 42A) faces the exit mechanism 112 in the insertion direction (arrow D direction) of the housing 104. Thus, in the image forming apparatus 10, the interference in the exit mechanism 112 of the developing device 46 and the surface of the photoreceptor 42 (photosensitive layer 42A) is suppressed and then occurrence of scratches on the surface of the photoreceptor 42 (photosensitive layer 42A) is suppressed compared to a configuration in which the guide section that guides the housing before the surface of the photoreceptor faces the exit mechanism of the developing device is not provided.

Next, an image forming apparatus of a second exemplary embodiment of the invention will be described with reference to FIG. 13. Moreover, the same reference numerals are given to the same configuration portions as the first exemplary embodiment described above and description thereof will be omitted.

Figure 13:
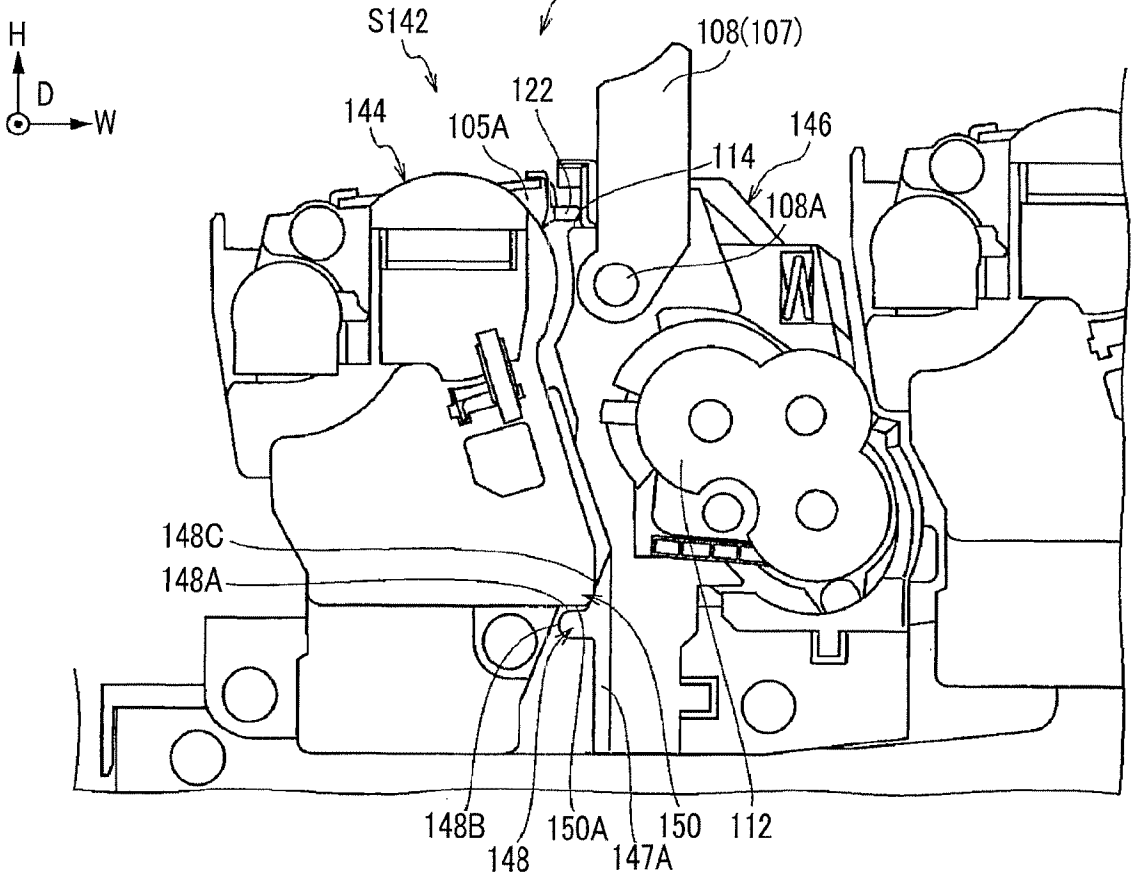
FIG. 13 is a front view illustrating a state where a housing that is used in an image forming apparatus according to a second exemplary embodiment of the invention is guided by guide sections in two portions, which are provided in a developing device adjacent to one side.

As illustrated in FIG. 13, an inserting and withdrawing structure S142 of a housing 144 including a photoreceptor (not illustrated) is provided in an image forming apparatus 140. The guide section 114 and a guide section 148 in two portions, which guide the housing 144 when the housing 144 is inserted or withdrawn into or from a developing device 146 (one developing device 146) of one side adjacent to the housing 144, are provided in the inserting and withdrawing structure S142. The guide section 148 is configured to protrude from a side wall portion 147A below the developing device 146 on a housing 144 side. In the exemplary embodiment, the guide section 148 includes an upper surface portion 148A that is disposed in the width direction (W direction) of the apparatus when viewed in a front view, a curved portion 148B that is disposed in an arc shape on a lower side from a tip of the upper surface portion 148A, and a wall portion 148C that is disposed on an upper side from an end portion of the upper surface portion 148A on an intermediate portion side in the width direction of the apparatus.

A protrusion section 150 that protrudes on a guide section 148 side and comes into contact with the guide section 148 is provided on a lower portion side of the housing 144. In the exemplary embodiment, a lower surface portion 150A of the protrusion section 150 is disposed in the width direction (W direction) of the apparatus when viewed in a front view and the lower surface portion 150A of the protrusion section 150 is configured to slide the upper surface portion 148A of the guide section 148.

The guide sections 114 and 148 in two portions are configured to guide the housing 144 before a surface of the photoreceptor (photosensitive layer, not illustrated) faces the exit mechanism 112 in the insertion direction (arrow D direction) of the housing 144. In this case, the guide section 114 on the upper side of the developing device 146 is provided in a position to guide the housing 144 in the insertion direction (arrow D direction) of the housing 144 prior to the guide section 148 on the lower side of the developing device 146.

In the image forming apparatus 140, when inserting the housing 144 into an insertion section of the image forming apparatus main body 102, the rib 122 on the upper side of the housing 104 is guided by the guide section 114 on the upper side of the developing device 146 on the inlet side of the housing 144 in the insertion direction (arrow D direction). Furthermore, the protrusion section 150 on the lower side of the housing 144 is guided by the guide section 148 on the lower side of the developing device 146.

In this case, the guide sections 114 and 148 in two portions are provided in positions in which guide of the housing 144 is started before the surface of the photoreceptor (photosensitive layer) faces the exit mechanism 112 in the insertion direction (arrow D direction) of the housing 144. Thus, in the image forming apparatus 140, interference in the exit mechanism 112 of the developing device 146 and the surface of the photoreceptor (photosensitive layer) is suppressed and then occurrence of scratches on the surface of the photoreceptor (photosensitive layer) is suppressed compared to a configuration in which a guide section that guides the housing before the surface of the photoreceptor faces the exit mechanism of the developing device is not provided.

Moreover, in the image forming apparatuses of the first and second exemplary embodiments described above, shapes, sizes, and positions of the guide sections in the two portions may be changed. In addition, shapes, sizes, and positions of portions of the housing coming into contact with the guide sections when being guided by the guide sections in the two portions may be also changed.

In addition, in the image forming apparatuses of the first and second exemplary embodiments described above, the positions of the guide sections in the two portions are shifted in the insertion direction, which guides the housing in the insertion direction of the housing, but the invention is not limited to the configuration, and the positions of the guide sections in the two portions guiding the housing in the insertion direction of the housing may not be shifted.

In addition, in the image forming apparatuses of the first and second exemplary embodiments described above, the guide sections in the two portions, which guide the housing including the photoreceptor are provided, but the invention is not limited to the configuration, and the guide sections in three or more portions, which guide the housing including the photoreceptor, may be provided. In this case, the guide sections in three or more portions may be provided only on the developing device of one side adjacent to the housing, or may be provided on both sides of the developing devices adjacent to both sides of the housing.

In addition, in the image forming apparatuses of the first and second exemplary embodiments described above, the charging device, the removing device, and the like are provided in the housing including the photoreceptor, but the invention is not limited to the configuration, and the configuration except the photoreceptor provided on the inside of the housing may be changed.

Furthermore, in the image forming apparatuses of the first and second exemplary embodiments described above, a shape, a size, and a position of the support section may be changed. In addition, a shape, a size, and a position of the housing that is supported by the support section may be also changed.

Furthermore, in the image forming apparatuses of the first and second exemplary embodiments described above, the number of the housings including the developing devices and the photoreceptors is four, but the invention is not limited to the configuration, and the number of the housings including the developing devices and the photoreceptors may be changed to be two or more.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of developing devices that are provided side by side in a direction that is defined by an image forming apparatus main body and respectively form insertion sections into or from which housings including photoreceptors are inserted or withdrawn in a longitudinal direction of the housings on a same side of the insertion sections in a direction in which the plurality of developing devices are arranged;

an exit mechanism that is provided in at least one of the plurality of the developing devices, is disposed on an inlet side of the insertion section, and exits a developer on an inside of the at least one of the plurality of developing devices; and guide sections of at least two portions provided in at least one of the plurality of developing devices adjacent to the housings start guiding at least one of the housings before a surface of at least one of the photoreceptors faces the exit mechanism in an insertion direction of the housings when at least one of the housings is inserted.

2. The image forming apparatus according to claim 1, further comprising:

a switching mechanism that switches contact and separation of the at least one of the plurality of developing devices with respect to the at least one housing, wherein at least one of the guide sections is provided at a position that does not move by an operation of the switching mechanism in the at least one of the plurality of developing devices.

3. The image forming apparatus according to claim 1, wherein the at least one housing includes a contact section coming into contact with the at least one of the guide sections, and wherein the contact section maintains a distance between the at least one of the photoreceptors and the at least one of the plurality developing devices in a state of being in contact with the at least one of the guide sections.

4. The image forming apparatus according to claim 2, wherein the at least one housing includes a contact section coming into contact with the at least one of the guide sections, and wherein the contact section maintains a distance between the at least one of the photoreceptors and the at least one of the plurality of developing devices in a state of being in contact with the at least one of the guide sections.

5. The image forming apparatus according claim 1, wherein the guide sections in the two portions are provided one by one in the plurality of developing devices on both sides adjacent to the housings.

6. The image forming apparatus according claim 2, wherein the guide sections in the two portions are provided one by one in the plurality of developing devices on both sides adjacent to the housings.

7. The image forming apparatus according claim 3, wherein the guide sections in the two portions are provided one by one in the plurality of developing devices on both sides adjacent to the housings.

8. The image forming apparatus according claim 4, wherein the guide sections in the two portions are provided one by one in the plurality of developing devices on both sides adjacent to the housings.

9. The image forming apparatus according claim 1, wherein positions of the guide sections in the two portions at which guide of the housing is started in the insertion direction of the housings are shifted in the insertion direction of the housings.

10. The image forming apparatus according claim 2, wherein positions of the guide sections in the two portions at which guide of the housings is started in the insertion direction of the housings are shifted in the insertion direction of the housings.

11. The image forming apparatus according claim 3, wherein positions of the guide sections in the two portions at which guide of the housings is started in the insertion direction of the housings are shifted in the insertion direction of the housings.

12. The image forming apparatus according claim 4, wherein positions of the guide sections in the two portions at which guide of the housings is started in the insertion direction of the housings are shifted in the insertion direction of the housings.

13. The image forming apparatus according claim 5, wherein positions of the guide sections in the two portions at which guide of the housings is started in the insertion direction of the housings are shifted in the insertion direction of the housings.

14. The image forming apparatus according claim 6, wherein positions of the guide sections in the two portions at which guide of the housings is started in the insertion direction of the housings are shifted in the insertion direction of the housings.

15. The image forming apparatus according claim 7, wherein positions of the guide sections in the two portions at which guide of the housings is started in the insertion direction of the housings are shifted in the insertion direction of the housings.

16. The image forming apparatus according claim 8, wherein positions of the guide sections in the two portions at which guide of the housings is started in the insertion direction of the housings are shifted in the insertion direction of the housings.

17. The image forming apparatus according claim 1, wherein a support section, that supports the housings in the insertion direction of the housings from contact positions with the guide sections and before a portion of the housings leaves the guide sections in the insertion direction of the housings is provided in the image forming apparatus main body.

18. The image forming apparatus according claim 2, wherein a support section, that supports the housings in the insertion direction of the housings from contact positions with the guide sections and before a portion of the housings leaves the guide sections in the insertion direction of the housings is provided in the image forming apparatus main body.

19. The image forming apparatus according claim 3, wherein a support section, that supports the housings in the insertion direction of the housings from contact positions with the guide sections and before a portion of the housings leaves the guide sections in the insertion direction of the housings is provided in the image forming apparatus main body.

20. The image forming apparatus according claim 4, wherein a support section, that supports the housings in the insertion direction of the housings from contact positions with the guide sections and before a portion of the housing leaves the guide sections in the insertion direction of the housings is provided in the image forming apparatus main body.

* * * * *